US006955296B2

(12) United States Patent
Lusher et al.

(10) Patent No.: US 6,955,296 B2
(45) Date of Patent: Oct. 18, 2005

(54) GUN CONTROL SYSTEM

(75) Inventors: Paul W. Lusher, King George, VA (US); Henry T. Rowland, Fredericksburg, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 157 days.

(21) Appl. No.: 10/609,898

(22) Filed: Jun. 26, 2003

(65) Prior Publication Data

US 2004/0262388 A1 Dec. 30, 2004

(51) Int. Cl.[7] ..... G06F 19/00

(52) U.S. Cl. ..... 235/400; 235/404; 235/411

(58) Field of Search ..... 235/400, 404, 235/405, 411, 412, 413, 414, 415, 416

(56) References Cited

U.S. PATENT DOCUMENTS

| | | | | |
|---|---|---|---|---|
| 3,845,276 | A | 10/1974 | Kendy et al. | 235/61.5 S |
| 4,112,818 | A | 9/1978 | Garehime | 89/41 TV |
| 4,319,242 | A | 3/1982 | Lewis | 343/6 R |
| 2003/0185420 | A1 * | 10/2003 | Sefcik et al. | 382/103 |

FOREIGN PATENT DOCUMENTS

JP 1239397 A2 9/1989

OTHER PUBLICATIONS

James D. Horner, "Combat System Architecture", Naval Surface Warefare Center, Dahlgren Division, Technical Digest, 1999, pp. 188-205.

FAS Military Analysis Network, "MK36 Gun Fire Control System (GFCS)", http://www.fas.org/man/dod-101/sys/ship/weaps/mk-36-gfcs.htm, updated Dec. 12, 1998, printed Jul. 8, 2001.

FAS Military Analysis Network, MK-2 Combat Control System:, http://www.fas.org/man/dod-101/sys/ship/weaps/mk-2.htm, updated Dec. 12, 1998, printed Jul. 8, 2001.

"Annex F Protect the Force", www.exwar.org/Whatsnew/awp/annexf.htm, printed Jul. 8, 2001.

* cited by examiner

*Primary Examiner*—Karl D. Frech
(74) *Attorney, Agent, or Firm*—Scott R. Boalick, Esq.; Matthew J. Bussan, Esq.

(57) ABSTRACT

A gun control system is disclosed that includes a fire control kernel and location-independent software components within the fire control kernel. The kernel provides core fire control functionality that is unaffected by changes within the external environment, such as changes to the physical configuration of the gun system of which the gun control system is a part. Each location-independent software component has a specific functionality, and is able to run on any processor within the system in a location-independent manner. These software components can include a target/track management interface software component, a gun control system control interface software component, a gun mount control interface software component, an ownship data interface software component, and a gun control system display interface software component.

17 Claims, 3 Drawing Sheets

GUN CONTROL SYSTEM

FIELD OF THE INVENTION

The invention relates generally to gunfire systems, and more particularly to gunfire control systems.

BACKGROUND OF THE INVENTION

Gun control systems are used to control the guns, or weapons, within vehicles, such as within ships. Traditionally, gun systems are designed so that the gunfire control systems are tightly coupled to the interfaces to the hardware of the system. Changing the physical configuration of a ship, such as replacing gun mounts, adding or changing sensors, or inserting other enhancements, is thus not an easy enhancement. The software design of the gun control system usually has to be changed as well, even though gunfire control has basic, well-understood processing requirements that are typically common to all current gun systems.

Therefore, gun system reconfiguration can be difficult to accomplish. Software engineers may have to be called in to redevelop aspects of the gun control system, to take into account the changes that have been made to the physical configuration of the gun system. Reconfiguring these systems in a cost-effective and time-efficient manner may be difficult to accomplish, involving significant time and effort. For these and other reasons, there is a need for the present invention.

SUMMARY OF THE INVENTION

A gun control system of the invention includes a fire control kernel and location-independent software components within the fire control kernel. The kernel provides core fire control functionality that is unaffected by changes within the external environment, such as changes to the physical configuration of the gun system of which the gun control system is a part. Each location-independent software component has a specific functionality, and is able to run on any processor within the system in a location-independent manner. That is, the location of the component within the system does not affect its execution, such that it runs in a location-independent manner. Examples of such software components include a target/track management interface software component, a gun control system control interface software component, a gun mount control interface software component, an ownship data interface software component, and a gun control system display interface software component.

The fire control kernel thus isolates the basic, core fire control functions. The core system functionality is unaffected by changes in the external environment in which the fire control kernel is housed. The basic fire control kernel does not have to be modified to accommodate changes in the ship class or the external systems connected to the gun control systems, such as sensors, command and control systems, and so on. Each of the location-independent software components can run on any processor within the gun control system without modification or reconfiguration. In this way, the core components are standalone objects that perform the necessary processing and computation, and output the appropriate results, regardless of where they are physically located within the gun control system.

The gun control system of the invention is flexible and adaptable to the specific external environment of its host gun system, or host gun platform. The gun control system provides for generic core fire control functions that are independent of the particular interfaces provided in a given gun system implementation. All component parts of the basic fire control problem domain are encompassed by the fire control system. These include core processing encapsulated in common operator controls, track filtering, ballistics, as well as gun order generation. The common kernel of fire control processing is independent of the specific sensors, gun mounts, stabilization elements, and other equipment of the overall gun system. Individual ship-specific, hardware-specific fire control components can be constructed as needed, and linked with the fire control kernel to provide a usable system.

Still other advantages, aspects, and embodiments of the invention will become apparent by reading the detailed description that follows, and by referring to the accompanying drawings.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated, and implications to the contrary are otherwise not to be made.

DETAILED DESCRIPTION OF THE INVENTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. For example, whereas the invention is substantially described in relation to a ship, it is applicable to other types of vehicles as well. The following detailed description is, therefore, not to be taken in a limiting sense, and the scope of the present invention is defined only by the appended claims.

Figure 1:
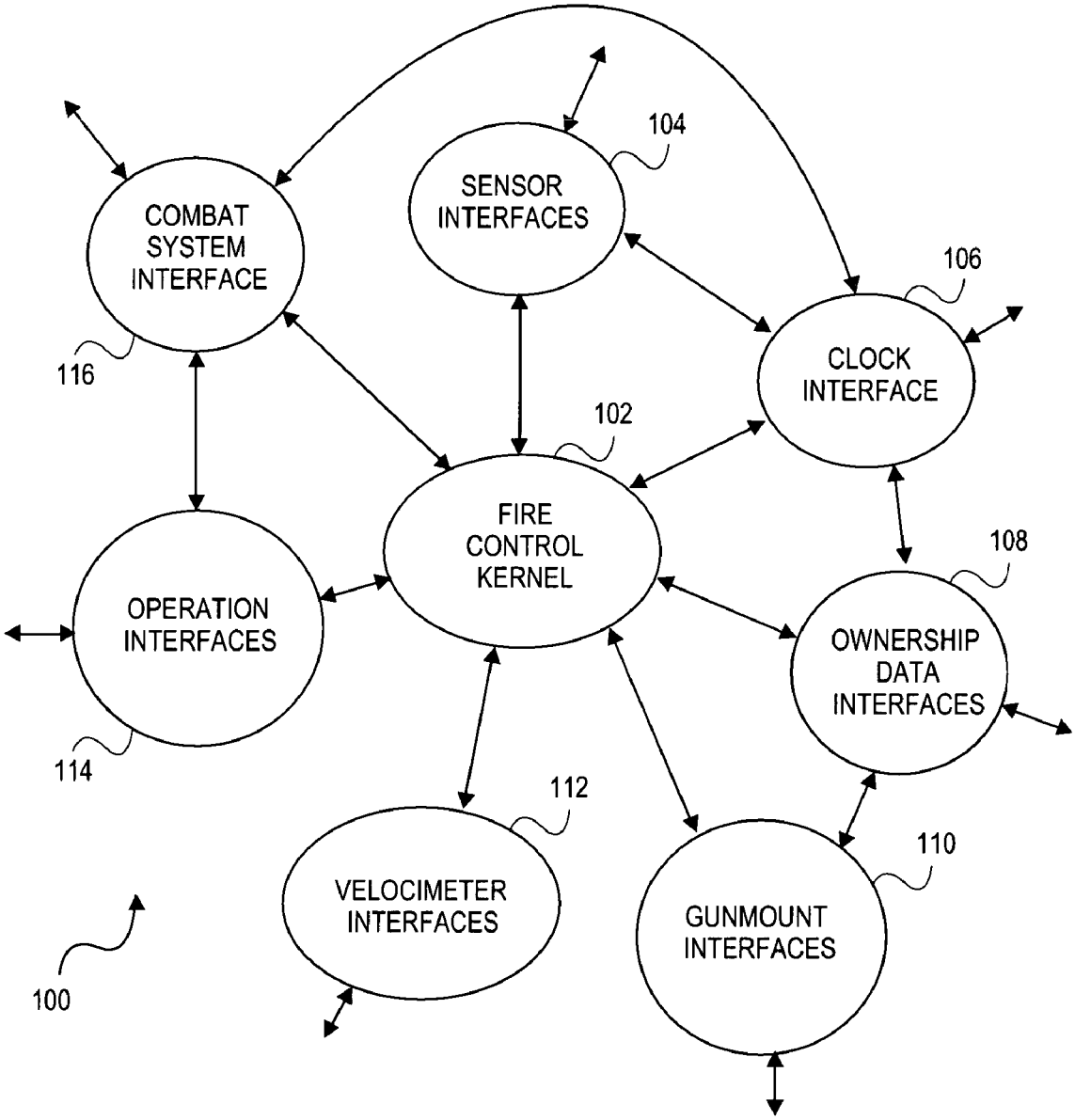
FIG. 1 is a diagram of a gun control system having a fire control kernel, according to an embodiment of the invention.

FIG. 1 shows a gun control system 100, according to an embodiment of the invention. The system 100 is a software system that can be employed with a variety of different gun (hardware) systems. That is, the system 100 is a baseline system that can be used to control different types of gun systems, having different types of hardware, weaponry, sensors, and so on. The system 100 includes a fire control kernel 102 that provides core fire control functionality unaffected by changes within the gun system of which the gun control system 100 is a part, and that is external to the fire control kernel 102. The system 100 also includes a number of infrastructure software components, including sensor interfaces 104, clock interfaces 106, ownship data interfaces 108, gun mount interfaces 110, velocimeter interfaces 112, operator interfaces 114, and combat system interfaces 116.

The fire control kernel 102 provides a general-purpose interface to the gun control system 100 in broad functional areas as is described later in the detailed description. The fire control kernel communicates with the infrastructure software components. The infrastructure software components specifically support the fire control kernel, so that the fire control kernel is able to operate independently of the gun system hardware within which it is deployed. That is, the infrastructure software components translate interface-specific data messages to the format and content required by the kernel 102. These external interface functions also generate any required external output messages, by accessing data via the fire control kernel 102. The gun control system 100 configures itself upon initialization so that it provides the specific external interface functionality, via the infrastructure software components, required for the hardware platform on which it resides.

For instance, the sensor interfaces 104 interface the fire control kernel 102 to specific hardware sensors of the gun system of which the gun control system 100 is a part. The sensor interfaces 104 also interface with the clock interfaces 106. The clock interfaces 106 interface the fire control kernel 102 to specific hardware clocks of the gun system, and also interface with the ownship data interfaces 108 and the combat system interfaces 116. The ownship data interfaces 108 interface the fire control kernel 102 to ownship data stores that may be present within the gun system of which the gun control system 100 is a part. The ownship data interfaces 108 also interface with the gun mount interfaces 110.

Furthermore, the gun mount interfaces 110 interface the fire control kernel 102 to gun mount hardware of the gun system. Similarly, the velocimeter interfaces 112 interface the fire control kernel 102 to velocimeter hardware of the gun system, and the operator interfaces 114 interface the fire control kernel 102 to operator user interface hardware of the gun system. The operator interfaces 114 also interface with the combat system interfaces 116. The combat system interfaces 116 interface the fire control kernel 102 to other hardware of the gun system of which the gun control system 100 is a part, as well as other combat systems that may communicate with the gun system.

Figure 2:
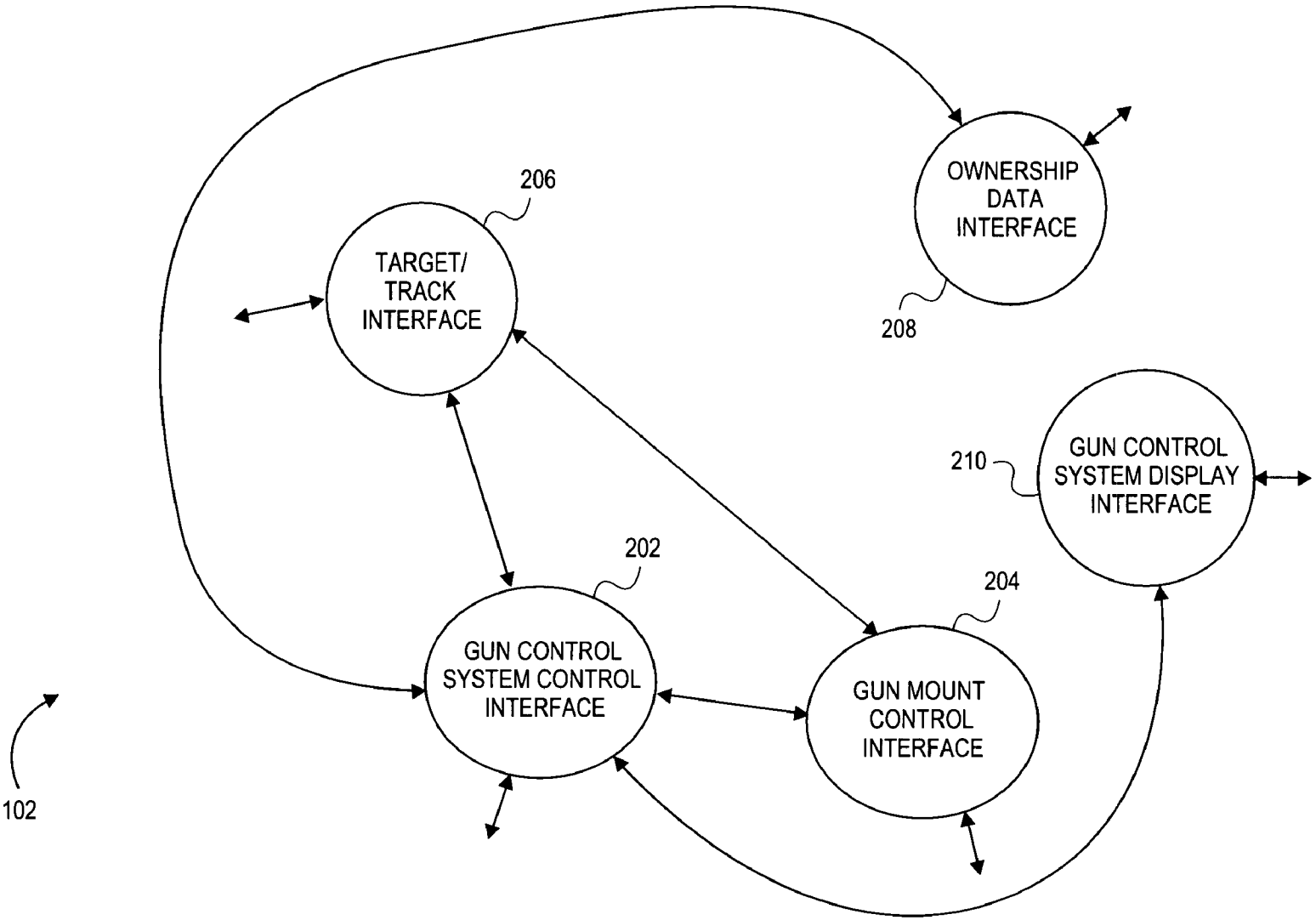
FIG. 2 is a diagram of the fire control kernel of the gun control system of FIG. 1, according to an embodiment of the invention.

FIG. 2 shows the fire control kernel 102 of the gun control system 100 in more detail, according to an embodiment of the invention. The fire control kernel 102 is made up of five software components. These components are the gun control system control interface 202, the gun mount control interface 204, the target/track interface 206, the ownship data interface 208, and the gun control system display interface 210. The software components are location independent, such that they are able to run on any processor within the gun system of which the gun control system 100 is a part in a location-independent manner. That is, the location of the software components within the gun system does not affect the execution of the components. Each software component has a specific functionality.

The gun control system interface 202 interfaces with the gun mount control interface 204, the target/track interface 206, the ownship data interface 210, the gun control system display interface 210, and also interfaces externally to the fire control kernel 102. The gun mount control interface also interfaces with the target/track interface 206, and interfaces externally to the fire control kernel 102. Each of the target/track interface 206, the ownship data interface 208, and the gun control system display interface further interfaces externally to the fire control kernel 102.

The gun control system control interface 202 provides for control of the kernel processing by both the gun control operator and external digital control sources. It accepts input of engagement controls, system doctrine, and gun control operator input controls and data values. It provides as output the engagement status, engagement order responses, overall system status, and controls of peripheral equipment within the gun control system 100.

Therefore, the gun control system control interface 202 provides overall control of all gun control system processing. In general, the control originates from both the gun system of which the gun control system 100 is a part, and the gun control operators. The interface 202 is responsible for accepting and acting on control data from all such sources. It provides control data to other gun control system processes. The gun control system interface 202 has three primary processing tasks: process operator controls, manage engagement and status, and determine average velocimeter initial velocity.

The gun mount control interface 204 provides access to the fire control kernel 102 for controlling the particular gun mount in used by the gun system of which the gun control system 100 is a part. It accepts as input gun position and status information, gun firing status information, and gun ammunition inventory information. It provides deck-referenced gun orders and rates, gun mount control commands, fire order control commands, and ammunition control and selection orders.

Therefore, the gun mount control interface 204 provides ballistics and gun orders processing. Such processing includes the solving of ballistics issues, the generation of gun orders, and the control of ballistics data. The solution of ballistics issues includes determining solutions for both conventional and guided rounds. The generation of gun orders converts the current ballistic solution and control data to data required to point and control a gun mount. The control of ballistics data establishes a control and sequencing environment of modes in which ballistic solutions and gun orders are computed.

The target/track interface 206 provides access to the fire control kernel 102 for all target-related and track-related data. It accepts input of both two-dimensional and three-dimensional sensor track data, indirect target data entered manually or via digital interfaces, sensor status information, and target number selection and reassignment information. It provides as output sensor designations, track data requests, and smoothed target state data.

Therefore, the target/track interface 206 manages sensors to process designations to the sensor, validate their data, and manage tracking of projectiles. The targets include those tracked by sensors, as well as manual targets and test and training targets. The targets are maintained in track data files that include estimated target state, sensors tracking the target, models used to estimate the target state, and an indication of estimated state quality. Thus, the target/track interface manages sensors, maintains target data, and supports navigation and ballistic requirements to engage shore and surface targets that cannot be directly tracked with sensors.

The ownship data interface 208 provides access into the fire control kernel 102 for all ownship state and attitude data needed for general fire control processing. It accepts as input ownship attitude information such as roll, pitch, heading, and rates, as well as ownship speed and course, ownship location in terms of latitude and land longitude, and environmental inputs. The ownship data interface 208 extrapolates these ownship parameters in time to provide ownship data valid at the same time as gun orders are computed to be valid.

The gun control system display interface 210 provides access into the fire control kernel 102 for extracting display data for the particular gun console in used by the gun control system 100. It accepts as input the console assignments for multiple-console configurations. It provides as output all the data needed to generate standard fire control displays. The gun control system display interface 210 preferably hides knowledge of the specific display device from other software components within the fire control kernel 102.

Figure 3:
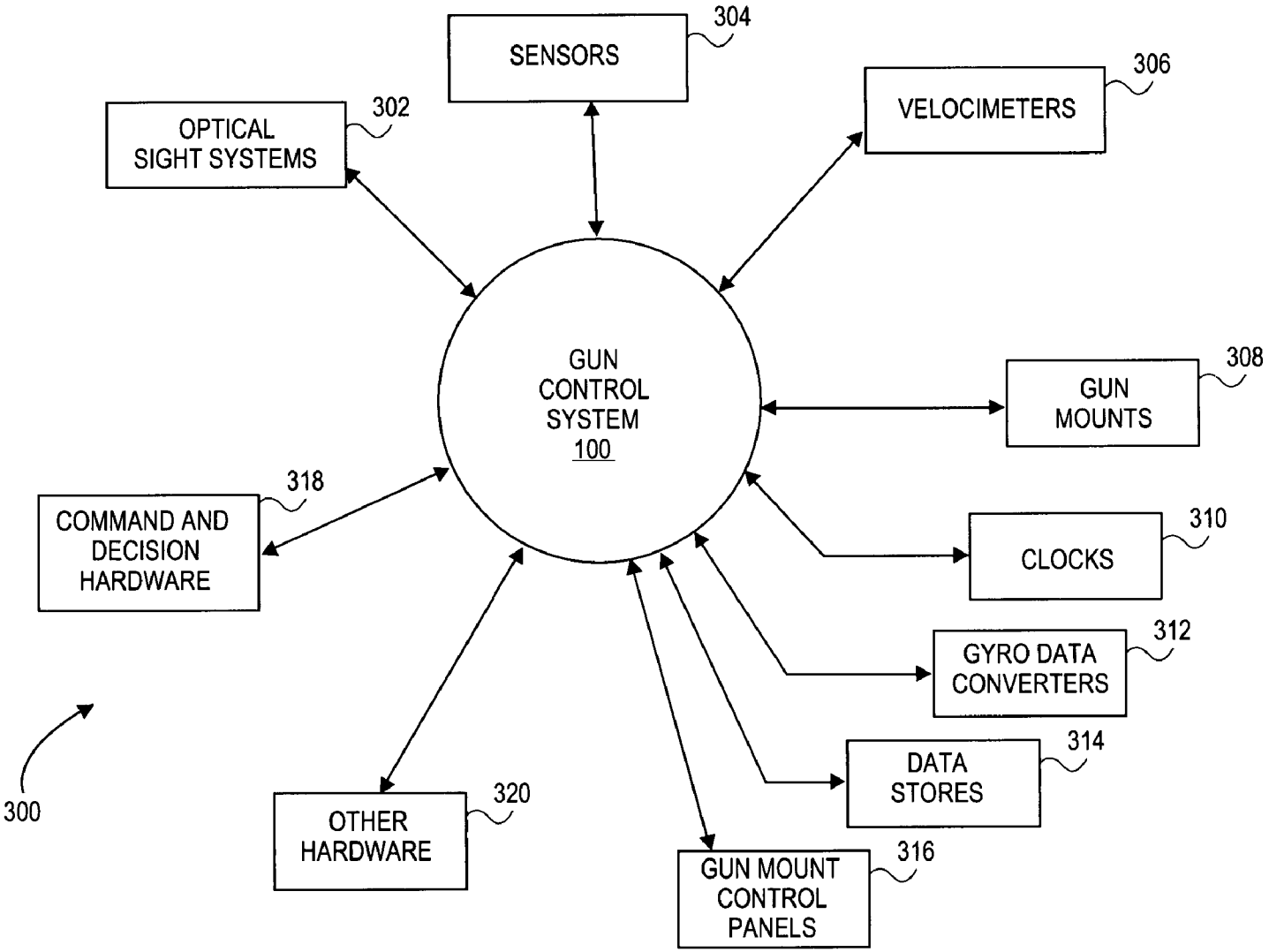
FIG. 3 is a diagram of a representative gun system in conjunction with which the gun control system of FIG. 1 can be implemented, according to an embodiment of the invention.

FIG. 3 shows a representative gun system 300, in conjunction with which the gun control system 100 may be implemented, according to an embodiment of the invention. The gun system 300 is specifically a naval gun system, although other embodiments of the invention are not so limited. The gun system 300 includes optical sight systems 302, sensors 304, velocimeters 306, gun mounts 308, clocks 310, gyro data converters 312, data stores 314, gun mount control panels 316, command and decision hardware 318, as well as other hardware 320.

The optical sight systems 302 are those systems that enable the gun system 300 to optically view targets, whereas the sensor 304 detect the targets, as well as provide other sensing data. The velocimeters 306 are devices that measure the speed of the targets within water, and the gun mounts 308 are the mounts on which the guns, or weapons, are mounted, and from which they can be fired. The clocks 310 provide various timing information. The gyro data converters 312 convert data from gyrocompasses for use by the gun control system 100. A gyrocompass is a compass with a motorized gyroscope whose angular momentum interacts with the force produced by the earth's rotation to maintain a north-south orientation of the gyroscopic spin axis, thus providing a stable directional reference.

The data stores 314 are various storage devices, such as hard disk drives and other types of storage devices, which store data for use by the gun control system 100. The gun mount control panels 316 are the control panels by which operators can control the gun mounts 308. The command and decision hardware 318 includes the hardware, such as computing devices and other types of devices, by which operators input commands and decisions into the gun control system 100, and which receive commands and decisions made by the gun control system 100. The gun control system 100 may interface with other hardware 320 as well.

It is noted that, although specific embodiments have been illustrated and described herein, it will be appreciated by those of ordinary skill in the art that any arrangement is calculated to achieve the same purpose may be substituted for the specific embodiments shown. For example, other applications and uses of embodiments of the invention, besides those described herein, are amenable to at least some embodiments. This application is intended to cover any adaptations or variations of the present invention. Therefore, it is manifestly intended that this invention be limited only by the claims and equivalents thereof.

We claim:

1. A gun control system comprising:

a fire control kernal providing core fire control functionality that is unaffected by changes within an environment external to the fire control kernel; and, a plurality of location-independent software components within the fire control kernel, each component having a specific functionality and able to run on any of a plurality of processors in a location-independent manner, wherein the plurality of location-independent software components comprises a gun mount control interface software component providing access into the fire control kernel for control of a gun mount currently in use, and wherein the gun mount control interface software component at least one of:

accepts as input gun position and status, gun firing status, and gun ammunition inventory; and, provides as output deck-reference gun orders and rates, gun mount controls, fire order controls, ammunition controls, and selection orders.

2. The gun control system of claim 1, further comprising an infrastructure component underlying the plurality of location-independent software components of the fire control kernel to support the components so that each component is able to operate independently of other components in the location-independent manner.

3. The gun control system of claim 1, wherein the plurality of location-independent software components comprises a target/track management interface software component providing access to the fire control kernel for target-related and track-related data.

4. The gun control system of claim 3, wherein the target/track management interface software component provides as output sensor designation data, track data requests, and smoothed target state data.

5. The gun control system of claim 1, wherein the plurality of location-independent software components comprises a gun control system control interface software component providing for control of kernel processing by a gun control operator and external digital control sources.

6. The gun control system of claim 1, wherein the plurality of location-independent software components comprises a gun control system display interface software component providing access into the fire control kernel for extracting display data for a gun mount currently in use.

7. The gun control system of claim 6, wherein the gun control system display interface software component accepts as input console assignment for multiple-console configurations.

8. The gun control system of claim 6, wherein the gun control system display interface software component provides as output necessary data to generate one or more fire control displays.

9. A gun control system comprising:

a fire control kernal providing core fire control functionality that is unaffected by changes within an environment external to the fire control kernel; and, a plurality of location-independent software components within the fire control kernel, each component having a specific functionality and able to run on any of a plurality of a processors in a location-independent manner, wherein the plurality of location-independent software components comprises a target/track management interface software component providing access to the fire control kernel for target-related and track-related data, and wherein the target/track management interface software component accepts as input two-dimensional and three-dimensional sensor track data, indirect target data, sensor status data, and target number selection and reassignments.

10. A gun control system comprising:

a fire control kernal providing core fire control functionality that is unaffected by changes within an environment external to the fire control kernel; and, a plurality of location-independent software components within the fire control kernel, each component having a specific functionality and able to run on any of a plurality of processors in a location-independent manner, wherein the plurality of location-independent software components comprises a gun control system control interface software component providing for control of kernel processing by a gun control operator and external digital control sources, and wherein the gun control system control interface software component at least one of:

accepts as input engage controls, system doctrine, and gun control operator console input controls and data; and, provides as output engagement status, engagement order responses, overall system status, and controls of peripheral equipment.

11. The gun control system of claim 10, wherein the plurality of location-independent software components comprises a gun mount control interface software component providing access into the fire control kernel for control of a gun mount currently in use.

12. The gun control system of claim 11, wherein the gun control mount control interface software component accepts as input gun position and status, gun firing status, and gun ammunition inventory.

13. The gun control system of claim 11, wherein the gun control mount control interface software component provides as output deck-reference gun orders and rates, gun mount controls, fire order controls, ammunition controls, and selection orders.

14. A gun control system comprising:

a fire control kernal providing core fire control functionality that is unaffected by changes within an environment external to the fire control kernel; and, a plurality of location-independent software components within the fire control kernel, each component having a specific functionality and able to run on any of a plurality of processors in a location-independent manner, wherein the plurality of location-independent software components comprises an ownship data interface software component providing access into the fire control kernel for ownship state and attitude data needed for general fire control processing.

15. The gun control system of claim 14, wherein the ownship data interface software component accepts as input ownship attitude data, ownship speed and course, ownship location, and environmental inputs.

16. A gun control system comprising:

a fire control kernal providing core fire control functionality that is unaffected by changes within an environment external to the fire control kernel;

a target/track management interface software component located within the fire control kernel and providing in a location-independent manner access to the fire control kernel for target-related and track-related data;

a gun control system control interface software component located within the fire control kernel and providing in the location-independent manner for control of kernel processing by a gun control operator and external digital control sources;

a gun mount control interface software component located within the fire control kernel and providing in the location-independent manner access into the fire control kernel for control of a gun mount currently in use;

an ownship data interface software component located within the fire control kernel and providing in the location-independent manner access into the fire control kernel for ownship state and attitude data needed for general fire control processing; and, a gun control system display interface software component located within the fire control kernel and providing in the location-independent manner access into the fire control kernel for extracting display data for a gun mount currently in use.

17. The gun control system of claim 16, further comprising an infrastructure component underlying the target/track management interface software component, the gun control system control interface software component, the gun mount control interface software component, the ownship data interface software component, and the gun control system display interface software component so that each component is able to operate independently of other components in the location-independent manner.

* * * * *